US006053769A

United States Patent [19]

Kubota et al.

[11] Patent Number: 6,053,769

[45] Date of Patent: Apr. 25, 2000

[54] COAXIAL CONNECTOR

[75] Inventors: Hiroshi Kubota; Hideaki Takeuchi, both of Nisshin, Japan

[73] Assignee: Advanced Mobile Telecommunication Technology Inc., Aichi, Japan

[21] Appl. No.: 09/256,288

[22] Filed: Feb. 24, 1999

[30] Foreign Application Priority Data

Feb. 27, 1998 [JP] Japan ..... 10-047824

[51] Int. Cl.[7] ..... H01R 9/05

[52] U.S. Cl. ..... 439/578; 174/75 C

[58] Field of Search ..... 439/578, 610, 439/98, 874; 174/78, 75 C, 88 C

[56] References Cited

U.S. PATENT DOCUMENTS

| | | | |
|---|---|---|---|
| 5,232,377 | 8/1993 | Leibfried, Jr. | 439/320 |
| 5,281,167 | 1/1994 | Le et al. | 439/578 |
| 5,607,325 | 3/1997 | Toma | 439/578 |

*Primary Examiner*—Steven L. Stephan
*Assistant Examiner*—Brian S. Webb
*Attorney, Agent, or Firm*—Lane, Aitken & McCann

[57] ABSTRACT

A coaxial connector is provided for a coaxial cable having an inner conductor, a dielectric member and an outer conductor which is made of a metal thin film. The coaxial connector comprises a connector pin electrically connected to the inner conductor, a cylindrical connector body formed with a through bore having part of said connector member and one end portion of the coaxial cable received therein, a cylindrical housing rotatably mounted around and in concentric and radially spaced relation with the cylindrical connector body so as to have the cylindrical connector body and the coaxial cable held at a standstill to each other, a tubular conductor having a cylindrical wall portion having a thickness larger than that of the outer conductor of the coaxial cable. The tubular conductor is interposed between the inner surface of the body and the outer surface of the coaxial cable in concentric and radially spaced relation therewith. The coaxial connector further comprises a solder layer intervening between the inner surface of the tubular conductor and the outer surface of the coaxial cable. The solder layer has a thickness larger than that of the outer conductor of the coaxial cable and smaller than that of the tubular conductor, thereby allowing the outer conductor to be electrically connected to the inner surface of the one end portion of the cylindrical connector body by way of the tubular conductor.

4 Claims, 4 Drawing Sheets

COAXIAL CONNECTOR

BACKGROUND OF THE INVENTION

1. Field of the Invention

The present invention relates to a coaxial connector, and more particularly, to a coaxial connector for a coaxial cable. The coaxial cable preferably comprises a cylindrical metal thin film serving as an outer conductor and is generally intended to transmit a high frequency signal therethrough.

2. Description of the Related Art

In recent years, a coaxial cable has been developed to have a high quality in its band width and a high reliability and used in various technical fields, for example, a mobile telecommunication system, a video signal transmission system and so on. As described above, the coaxial cable of this type generally comprises a cylindrical metal thin film serving as an outer conductor and is adapted to transmit a high frequency signal therethrough.

For instance, the mobile telecommunication system includes a base station. In the base station, the system comprises an antenna, a band-pass filter and an amplifier. The antenna is adapted to receive a radio wave signal having a faint level. The amplifier is designed to amplify the signal which is passed through the band-pass filter. The coaxial cable is used for the electrical connection between the antenna, the band-pass filter and the amplifier.

Recently, the band-pass filter has been developed into a high efficient filter including a high temperature superconductor (hereinlater referred to as "HTS filter"). The HTS filter is generally accommodated in a refrigerated vacuum chamber and has the coaxial cable of the type above mentioned used for the electrical connection between the antenna and the amplifier.

The coaxial cable is generally used in conjunction with a coaxial connector for electrically and mechanically connecting one device to the other device therethrough. The coaxial connector has been also developed with the advance of high technology to have a high quality commensurate with that of the coaxial cable.

Referring to FIG. 4 of the drawings, there is shown a conventional coaxial connector 60 suitable for this type of coaxial cable 50. The coaxial cable 50 comprises a cylindrical inner conductor 51, a tubular dielectric member 52, and a tubular outer conductor 53. The inner conductor 51 is made of a conductive wire having a circular cross-section taken along a plane perpendicular to its longitudinal axis. The dielectric member 52 encircles and supports the inner conductor 51. The outer conductor 53 is made of a metal thin film having a predetermined thickness and covers the outer surface of the dielectric member 52. The coaxial cable 50 is electrically connected to some devices, not shown, at its both ends by way of respective coaxial connectors 60.

The coaxial connector 60 comprises a connector pin 61 electrically connected to the inner conductor 51 and having a center axis axially aligned with the center axis of the coaxial cable 50, a cylindrical connector body 62 electrically connected to the outer conductor 53, a cylindrical dielectric member 63 disposed between the connector pin 61 and the connector body 62, and an outer housing 65. The cylindrical connector body 62 is adapted to retain one end portion of the coaxial cable 50 and part of the connector pin 61. The cylindrical connector body 62 is welded to the outer conductor 53 of the coaxial cable 50 at a solder portion 71. The outer housing 65 is rotatably mounted around and in concentric and radially spaced relation with the cylindrical connector body 62 through a snap ring 64 so as to have the cylindrical connector body 62 to the coaxial cable 50 held at a standstill to each other.

The conventional coaxial connector 60 as described above and shown in FIG. 4, however, has a drawback to be encountered in its electrical property. In the coaxial connector 60, the thin film of the outer conductor 53 of the coaxial cable 50 is liable to be deformed or peel off from the dielectric member 52 of the coaxial cable 50 during a heating process to melt solder to connect the coaxial connector 60 to the coaxial cable 50 at the solder portion 71. The deformation or peeling of the outer conductor 53 of the coaxial cable 50 is also frequently caused at the end of the coaxial cable 50 near the coaxial connector 60 whenever the coaxial cable 50 is bent. These phenomena are apt to lead to a trouble that the electrical property of the coaxial connector 60 as well as the coaxial cable 50 is extremely deteriorated. Furthermore, it is difficult to form the solder portion 71 uniformly. As a result, some thermal shock causes cracks in an uneven portion of the solder portion 71.

The other type of coaxial connector for the coaxial cable, such as a collet chuck type of coaxial connector, is disclosed in U.S. patent application Ser. No. 821,294, filed Mar. 20, 1997, by the same applicant. The above type of coaxial connector comprises a clamp having the collet chuck type of structure instead of a solder portion for electrically and mechanically connecting the coaxial cable to the coaxial connector.

The coaxial connector of this type can be used for thin film coated coaxial cables thereby achieving a high performance of its electrical property and a high thermal conductivity. However, the coaxial connector of the collet chuck type generally has complex structures. For this reason, the coaxial connector cannot be reduced small in size and produced at a relatively low cost. The collet chuck type of coaxial connector further encounters a drawback in its insertion loss as described below. The collet chuck type of coaxial connector is generally applied to the coaxial cable coated with the metal thin film as described above. The coaxial connector for the thin film coated coaxial cable causes the high insertion loss in comparison with the coaxial connector for the semi-rigid type of coaxial cable.

The insertion losses of the cable and connector were measured in order to evaluate the coaxial connector for the thin film coated coaxial cable in comparison with that of the connector for the semi-rigid type of coaxial cable.

The measurements were conducted under the condition that the high frequency signal is transmitted though the connector and cable at a frequency of 5 GHz. The results of the measurements indicate that the insertion loss of the semi-rigid type of coaxial cable indicates 0.008 dB/cm while the insertion loss of the coaxial connector indicates 0.010 dB per one connector. In comparison with these results, the insertion loss of the thin film coated coaxial cable indicates 0.008 dB/cm which is the same as that of the semi-rigid type of coaxial cable while the insertion loss of the coaxial connector indicates 0.042 dB per one connector which is four times larger than that of the connector for the semi-rigid type of coaxial cable. From the foregoing it will be seen that the collet chuck type of coaxial connector has a disadvantage against the connector for the semi-rigid type of coaxial cable in its insertion loss when the coaxial connector is used for the thin film coated coaxial cable.

Furthermore, the other type of coaxial connector comprising a ferrule which is adapted to connect the cable to the connector therethrough is disclosed in Japanese laid-opened Publication No. 01-130485 (Kauffman; Roger S.) corresponding to U.S. patent application Ser. No. 112,910, filed Oct. 23, 1987.

SUMMARY OF THE INVENTION

In is therefore an object of the present invention to provide a coaxial connector for a coaxial cable which can prevent the coaxial cable from deforming its outer conductor.

It is another object of the present invention to provide a coaxial connector for a coaxial cable which can simplify its structure to reduce its cost.

It is a further object of the present invention to provide a coaxial connector for a coaxial cable which can achieve a high performance of the electrical property.

It is an also object of the present invention to provide a coaxial connector for a coaxial cable can adjust the center axis of the coaxial connector with that of the coaxial cable with accuracy, thereby having an effective high frequency property.

In accordance with an aspect of the present invention, there is provided a coaxial connector for electrically and mechanically connecting a coaxial cable to a certain device, wherein the coaxial cable has a cylindrical inner conductor, a cylindrical outer conductor disposed in concentric and radially spaced relation with the inner conductor, and a dielectric member provided between the inner conductor and the outer conductor to encircle and support the inner conductor in coaxial relationship with the outer conductor. The coaxial connector comprises: a connector member having a center axis axially aligned with the center axis of the coaxial cable and electrically connected to the inner conductor, a cylindrical body having one end portion and the other end portion having an inner diameter larger than that of the one end portion, and a tubular dielectric member disposed between the connector member and the cylindrical body. The one end portion is formed with a through bore having a center axis substantially coincide with the center axis of coaxial cable and disposed in concentric and radially spaced relation with one end portion of the coaxial cable. The other end portion is formed with a through bore having a center axis substantially coincide with the center axis of connector member and disposed in concentric and radially spaced relation with part of the connector member. The coaxial connector further comprises a housing rotatably mounted around and in concentric and radially spaced relation with the cylindrical body so as to have the cylindrical body and the coaxial cable held at a standstill to each other; a tubular conductor having a cylindrical wall portion having a thickness larger than that of the outer conductor of the coaxial cable, and interposed between the inner surface of the body and the outer surface of the coaxial cable in concentric and radially spaced relation therewith; and a solder layer intervening between the inner surface of the tubular conductor and the outer surface of the coaxial cable, and having a thickness larger than that of the outer conductor of the coaxial cable and smaller than that of the tubular conductor, thereby allowing the outer conductor to be electrically connected to the inner surface of the one end portion of the cylindrical body by way of the tubular conductor.

In the aforesaid coaxial connector, the outer conductor of the coaxial cable may be formed with a thin film so as to cover the dielectric member therewith. Furthermore, the tubular conductor may have a linear expansion coefficient less than that of the outer conductor of the coaxial cable and more than that of the cylindrical body. More preferably, the linear expansion coefficient of the tubular conductor may be substantially same as that of the outer conductor of the coaxial cable.

BRIEF DESCRIPTION OF THE DRAWINGS

The present invention and many of the advantages thereof will be better understood from the following detailed description when considered in connection with the accompanying drawings, wherein.

DESCRIPTION OF THE PREFERRED EMBODIMENTS

Figure 1:
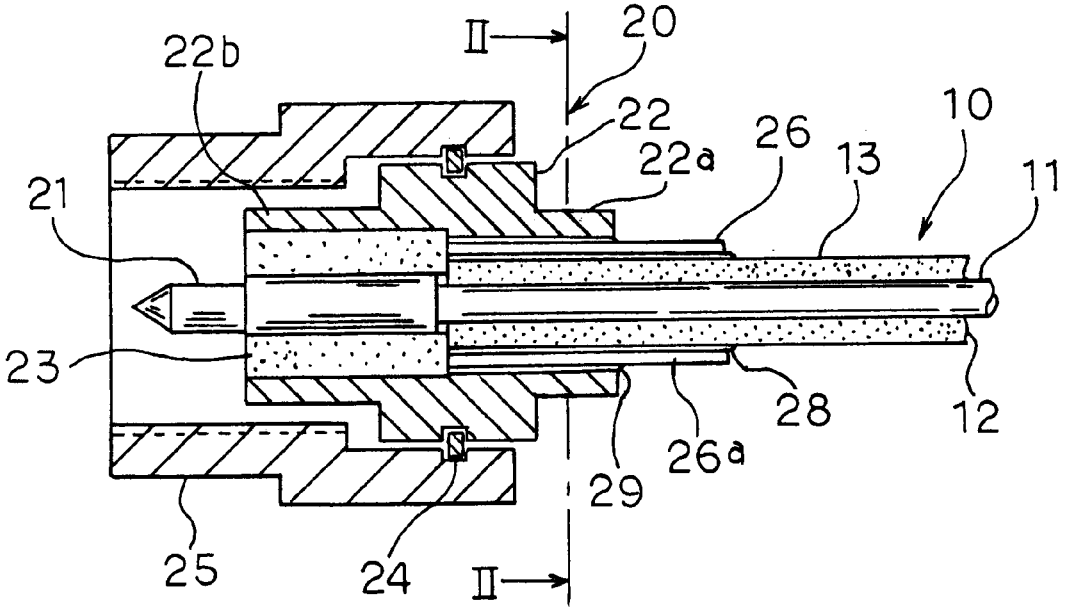
FIG. 1 is an axial cross sectional view of a preferred embodiment of the coaxial connector according to the present invention.

Throughout the following detailed description, similar reference characters respectively refer to similar elements in all figures of the drawings.

Figure 2:
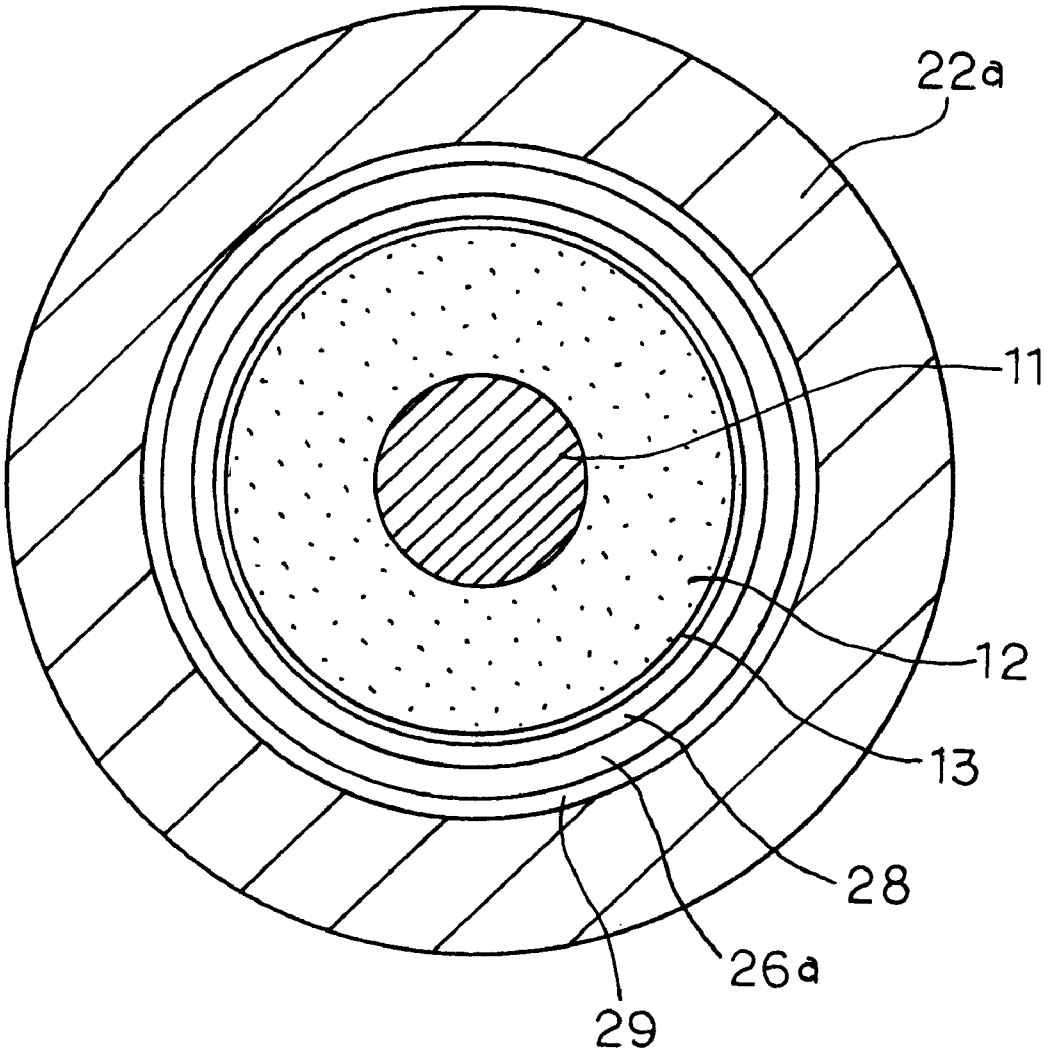
FIG. 2 is an enlarged cross sectional view taken along the line II—II of FIG. 1.
Figure 3:
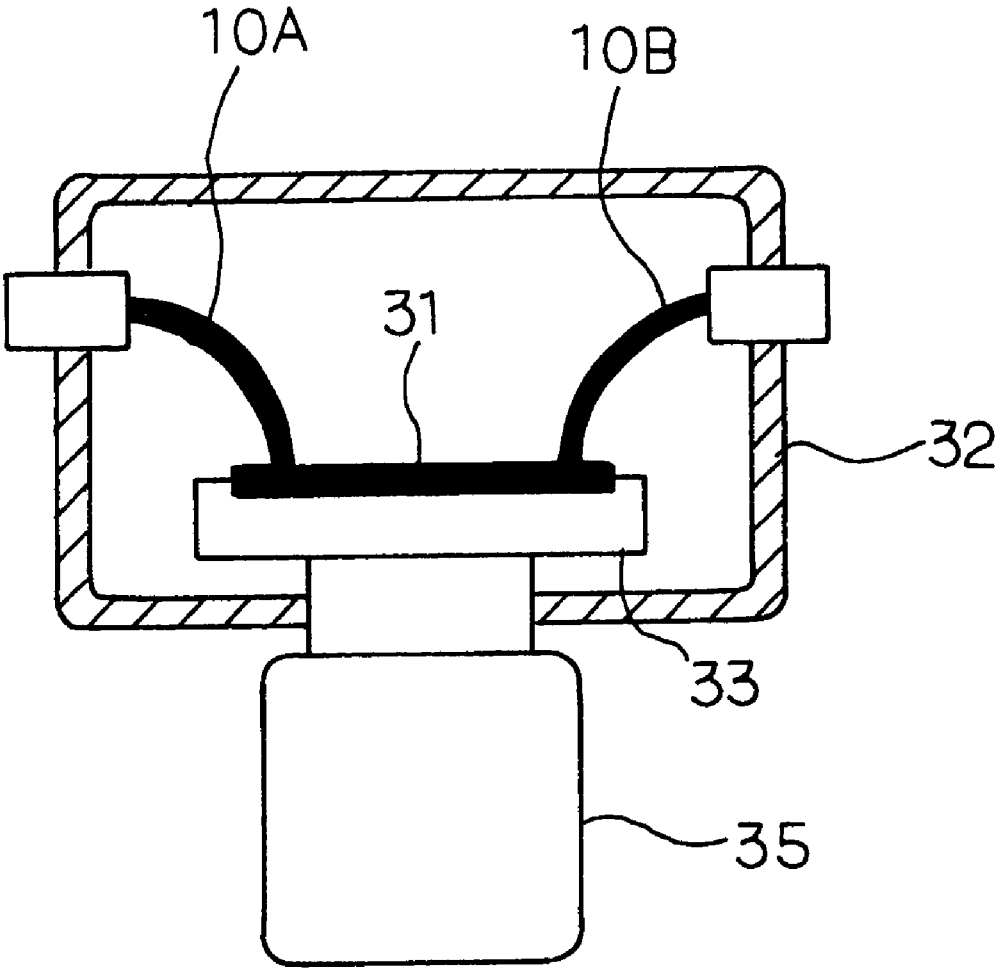
FIG. 3 is a block diagram showing an example of the coaxial connector shown in FIG. 1 which is employed for a superconductor device.
Figure 4:
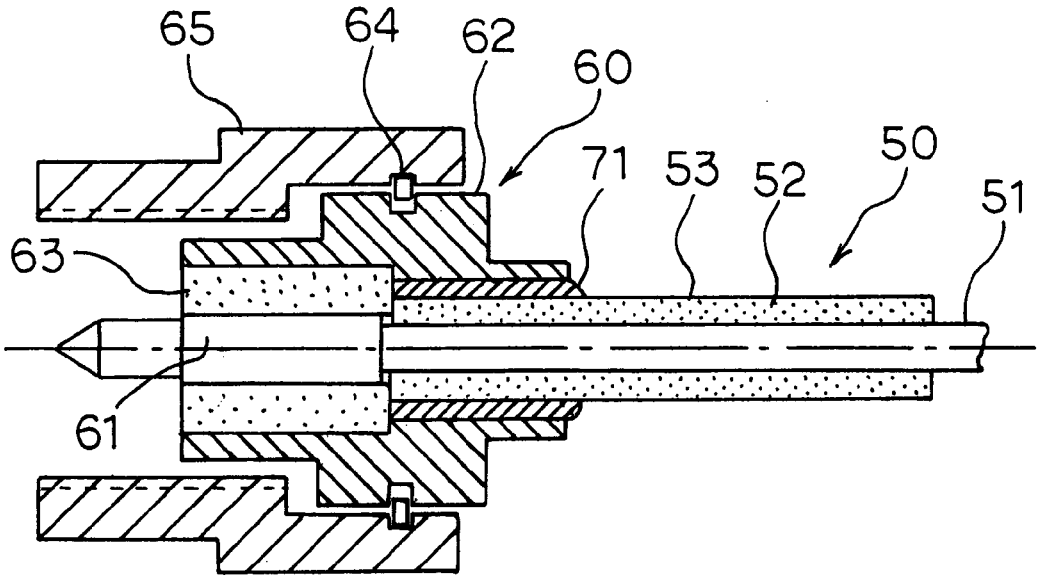
FIG. 4 PRIOR ART
FIG. 4 is an axial cross sectional view of a conventional connector.

Referring now to FIGS. 1 to 3 of the drawings, there is shown a preferred embodiment of the coaxial connector according to the present invention. The coaxial connector 20 is adapted to electrically and mechanically connecting a coaxial cable 10 to a certain device.

The coaxial cable 10 generally allows a high frequency signal to be transmitted therethrough. As shown in FIGS. 1 and 2, the coaxial cable 10 has a circular cross-section taken along the line II—II of FIG. 1 which is substantially perpendicular to its longitudinal axis. The coaxial cable 10 has a cylindrical inner conductor 11, a cylindrical outer conductor 13 disposed in concentric and radially spaced relation with the inner conductor 11, and a dielectric member 12 provided between the inner conductor 11 and the outer conductor 13 to encircle and support the inner conductor 11 in coaxial relationship with the outer conductor 13.

The inner conductor 11 of the coaxial cable 10 preferably has a core conductive wire made of an iron, and a metal thin film made of copper or silver and encircling the core wire therewith. Alternatively, the inner conductor 11 of the coaxial cable 10 may have a beryllium core wire plated with a silver, a copper core wire plated with a tin, or the like. The inner conductor 11 of the coaxial cable 10 thus constructed can have a desired mechanical strength.

The dielectric member 12 of the coaxial cable 10 is preferably made of a dielectric material selected from a group consisting of polytetrafluoroethylene (PTFE), polyethylene (PE), tetrafluoroethylene-hexafluoropropylene (FEP), and tetrafluoroethylene-perfluoroalkylvinylether (PFA).

The outer conductor 13 of the coaxial cable 10 is made of a conductive material selected from a group consisting of copper, gold, aluminum, nickel steel and stainless steel. The outer conductor 13 of the coaxial cable 10 is formed with a thin film so as to cover the dielectric member 12 therewith. The thickness of the outer conductor 13 of the coaxial cable 10 is about 5 $\mu$m.

There is shown in FIG. 3 an example of the use of the coaxial cable 10 thus constructed for electrically connecting a superconductor device 31 to the other electronic devices therethrough. The superconductor device 31 is a band-pass filter including a high temperature superconductor. The superconductor device 31 is housed in an adiabatic vacuum container 32 which is cooled by a small-sized refrigerator 35 having a cold head 33. The superconductor device 31 is mounted on the cold head 33 of the refrigerator 35. The superconductor device 31 has two terminals respectively electrically connected to coaxial cables 10*a* and 10*b* through the coaxial connectors, not shown in FIG. 3, which will be described in detail hereinafter.

The coaxial connector 20 comprises a connector pin 21, a cylindrical connector body 22, and a tubular dielectric member 23 disposed between the connector pin 21 and the cylindrical connector body 22.

The connector pin 21 has a center axis axially aligned with the center axis of the inner conductor 11 of the coaxial cable 10. The connector pin 21 is electrically connected to the inner conductor 11.

The cylindrical connector body 22 of the coaxial connector 20 has one end portion 22*a* and the other end portion 22*b* having an inner diameter larger than that of the one end portion 22*a*. The one end portion 22*a* of the cylindrical connector body 22 is formed with a through bore having a center axis substantially coincide with the center axis of coaxial cable 10 and disposed in concentric and radially spaced relation with one end portion of the coaxial cable 10. The other end portion 22*b* of the cylindrical connector body 22 is formed with a through bore having a center axis substantially coincide with the center axis of connector member 21 and disposed in concentric and radially spaced relation with part of the connector member 21. The cylindrical connector body 22 of the coaxial connector 20 is made of a stainless steel and coated with gold.

The coaxial connector 20 further comprises a tubular conductor 26 for electrically connecting the coaxial cable 10 and the connector body 22 of the coaxial connector 20 to each other. The tubular conductor 26 has a cylindrical wall portion 26*a* interposed between the inner surface of the connector body 22 and the outer surface of the coaxial cable 10 in concentric and radially spaced relation therewith. The cylindrical wall portion 26*a* of the tubular conductor 26 has a thickness larger than that of the outer conductor 13 of the coaxial cable 10 and smaller than that of the one end portion 22*a* of the cylindrical connector body 22. The tubular conductor 26 has a linear expansion coefficient less than that of the outer conductor 13 of the coaxial cable 10 and more than that of the cylindrical connector body 22. More specifically, the linear expansion coefficient of the tubular conductor 26 may be substantially same as that of the outer conductor 13 of the coaxial cable 10. Preferably, the tubular conductor 26 may be made of a material selected from a group consisting of copper and silver. With the tubular conductor 26 thus constructed, the coaxial connector can be improved in its reliability in the electrical connection between the outer conductor 13 of the coaxial connector 10 and the connector body 22 of the coaxial connector 20.

The coaxial connector 20 further comprises a solder layer 28 interposed between the inner surface of the tubular conductor 26 and the outer surface of the outer conductor 13 of the coaxial cable 10. The solder layer 28 has a thickness larger than that of the outer conductor 13 of the coaxial cable 10 and smaller than that of the cylindrical wall portion 26*a* of the tubular conductor 26, thereby allowing the outer conductor 13 of the coaxial connector 10 to be electrically secured to the inner surface of the one end portion 22*a* of the cylindrical connector body 22 of the coaxial connector 20 by way of the tubular conductor 26 of the coaxial connector 20.

The solder layer 28 generally has a resistance value larger than that of outer conductor 13 of the coaxial cable 10 and the tubular conductor 26. This means that the electrical property is deteriorated, as the thickness of the solder layer 28 is relatively larger. In the coaxial connector according to the present invention, the gap between the outer conductor 13 of the coaxial cable 10 and the cylindrical wall portion 26*a* of the tubular conductor 26 can become small enough to introduce the welded solder thereto by the capillary phenomenon action. Therefore, the solder layer 28 of the coaxial connector 20 can be uniformly formed with a thin layer by introducing the welded solder into the gap between the outer conductor 13 of the coaxial cable 10 and the cylindrical wall portion 26*a* of the tubular conductor 26. This leads to the fact that the coaxial connector can prevent the solder layer 28 from causing cracks due to thermal shock as well as be improved in its electrical property.

Furthermore, the coaxial connector 20 can adjust the center axis of the coaxial connector 20 with that of the coaxial cable 10 with accuracy because of the fact that the solder layer 28 of the coaxial connector 20 can be uniformly formed. This means that the present invention can provide a coaxial connector having an effective high frequency property.

The solder layer 28 may be made of a cream type of soft solder. In this case, the outer surface of the outer conductor 13 of the coaxial cable 10 and the inner surface of the tubular conductor 26 are coated with the soft solder before the outer conductor 13 of the coaxial cable 10 is inserted into the tubular conductor 26.

The coaxial connector 20 may further comprise a solder layer 29 interposed between the connector body 22 and the tubular conductor 26. The thickness of the solder layer 29 may be substantially the same as that of the solder layer 28. The solder layer 29 may be replaced with another conductive material through which the connector body 22 and the tubular conductor 26 can be detachably connected with each other. Alternatively, the connection between the cylindrical conductor 26 and the connector body 22 may be made in the conventional clamping manner.

The coaxial connector 20 further comprises a connector housing 25 rotatably mounted around and in concentric and radially spaced relation with the cylindrical connector body 22 by way of a snap ring 24 so as to have the cylindrical connector body 22 and the coaxial cable 10 held at a standstill to each other.

The insertion losses of the coaxial connectors are measured in order to evaluate the coaxial connector according to the present invention. The measurements of the insertion losses of the coaxial connectors are conducted at a signal frequency of 1.5 GHz. There are prepared three different types of coaxial cables which have dielectric members 12 having outside diameters of 1.05, 1.67, and 2.98 mm. As a comparative example, the collet chuck type of connector as described in the prior art is used in conjunction with each of the coaxial cables.

TABLE 1

| OUTSIDE DIAMETER OF DIELECTRIC MEMBER (mm) | INSERTION LOSS (dB) COAXIAL CONNECTOR OF EMBODIMENT | COMPARATIVE EXAMPLE: COLLET CHUCK TYPE OF CONNECTOR |
|---|---|---|
| 1.05 | 0.019 | 0.076 |
| 1.67 | 0.013 | 0.038 |
| 2.98 | 0.005 | 0.028 |

It will be clearly appreciated from the foregoing results shown in Table 1 that the coaxial connector according to the present invention is superior to the collet chuck type of connector in the insertion loss.

As many apparently widely different embodiments of this invention may be made without departing from the spirit and scope thereof, it is to be understood that the invention is not limited to the specific embodiments thereof except as defined in the appended claims.

What is claimed is:

1. A coaxial connector for electrically and mechanically connecting a coaxial cable to a certain device, said coaxial cable having a cylindrical inner conductor, a cylindrical outer conductor disposed in concentric and radially spaced relation with said inner conductor, and a dielectric member provided between said inner conductor and said outer conductor to encircle and support said inner conductor in coaxial relationship with said outer conductor, said coaxial connector comprising:

a connector member having a center axis axially aligned with the center axis of said coaxial cable and electrically connected to said inner conductor;

a cylindrical body having one end portion and the other end portion having an inner diameter larger than that of the one end portion, said one end portion formed with a through bore having a center axis substantially coincide with said center axis of coaxial cable and disposed in concentric and radially spaced relation with one end portion of said coaxial cable, and said other end portion formed with a through bore having a center axis substantially coincide with said center axis of connector member and disposed in concentric and radially spaced relation with part of said connector member;

a tubular dielectric member disposed between said connector member and said cylindrical body;

a housing rotatably mounted around and in concentric and radially spaced relation with the cylindrical body so as to have said cylindrical body and said coaxial cable held at a standstill to each other;

a tubular conductor having a cylindrical wall portion having a thickness larger than that of the outer conductor of the coaxial cable, and interposed between the inner surface of said body and the outer surface of said coaxial cable in concentric and radially spaced relation therewith; and a solder layer intervening between the inner surface of said tubular conductor and the outer surface of said coaxial cable, and having a thickness larger than that of said outer conductor of said coaxial cable and smaller than that of said tubular conductor, thereby allowing said outer conductor to be electrically connected to the inner surface of said one end portion of said cylindrical body by way of said tubular conductor.

2. The coaxial connector as set forth in claim 1, in which said outer conductor of said coaxial cable is formed with a thin film so as to cover said dielectric member therewith.

3. The coaxial connector as set forth in claim 1, in which said tubular conductor has a linear expansion coefficient less than that of said outer conductor of said coaxial cable and more than that of said cylindrical body.

4. The coaxial connector as set forth in claim 3, in which said linear expansion coefficient of said tubular conductor is substantially same as that of said outer conductor of said coaxial cable.

* * * * *